US006923401B2

(12) United States Patent
Lock

(10) Patent No.: US 6,923,401 B2
(45) Date of Patent: Aug. 2, 2005

(54) METHOD FOR UNWINDING ELASTOMERIC YARN FROM COILED PACKAGES

(75) Inventor: Robert Lock, Waynesboro, VA (US)

(73) Assignee: Invista North America S.a.r.l., Wilmington, DE (US)

( * ) Notice: Subject to any disclaimer, the term of this patent is extended or adjusted under 35 U.S.C. 154(b) by 134 days.

(21) Appl. No.: 10/408,196

(22) Filed: Apr. 7, 2003

(65) Prior Publication Data

US 2004/0195426 A1 Oct. 7, 2004

(51) Int. Cl.[7] ..... B65H 21/00; B65H 49/02; B65H 55/00

(52) U.S. Cl. ..... 242/553; 242/551; 242/560.2; 242/131; 242/131.1; 242/172

(58) Field of Search ..... 242/551, 553, 242/560.2, 593, 129, 131, 131.1, 363, 172, 173

(56) References Cited

U.S. PATENT DOCUMENTS

| | | | | |
|---|---|---|---|---|
| 2,574,455 A | | 11/1951 | Abbott | |
| 2,630,280 A | | 3/1953 | Wedler | |
| 3,731,792 A | | 5/1973 | Rolston | |
| 4,022,396 A | * | 5/1977 | Manchester et al. | 242/160.2 |
| 4,460,086 A | | 7/1984 | Davis | |
| 4,515,328 A | * | 5/1985 | Payne, Jr. | 242/131 |
| 4,673,140 A | * | 6/1987 | Boles | 242/128 |
| 5,129,593 A | * | 7/1992 | Smith | 242/159 |
| 5,310,056 A | * | 5/1994 | Ball | 206/390 |
| 6,802,467 B2 | * | 10/2004 | Abba et al. | 242/167 |
| 2003/0132339 A1 | * | 7/2003 | McCarthy | 242/588.1 |

FOREIGN PATENT DOCUMENTS

| | | |
|---|---|---|
| DE | 40 05 788 A | 3/1953 |
| GB | 2 142 941 A | 1/1985 |
| JP | 04091246 | 3/1992 |
| JP | 2987463 B2 | 12/1999 |

* cited by examiner

*Primary Examiner*—Eileen D. Lillis
*Assistant Examiner*—Evan H Langdon
(74) *Attorney, Agent, or Firm*—Robert B. Furr, Jr.

(57) ABSTRACT

A method for unwinding tacky elastomeric yarn from one or multiple coiled yarn packages includes the steps of (a) removing tubular cores from each yarn package to expose the beginning end of the yarn strand at the inner diameter of the yarn package; (b) forming a terminal end of the yarn strand at a position along the length of the strand between the inner diameter and outer diameter of the yarn package; (c) when unwinding multiple coiled yarn packages, attaching the terminal end of the first yarn package to a beginning end of a next yarn package; and (d) unwinding by pulling the beginning end of the first yarn package in a generally axial direction to remove yarn from the inside of the package from the inner diameter toward the outer diameter. This method provides inside-out unwinding of a single package, or continuous unwinding of multiple packages of elastomeric yarn at a reduced overall yarn tension, and minimizes unwinding tension spikes.

17 Claims, 5 Drawing Sheets

METHOD FOR UNWINDING ELASTOMERIC YARN FROM COILED PACKAGES

BACKGROUND OF THE INVENTION

Elastomeric yarns consist of single or multiple elastomeric fibers that are manufactured in fiber-spinning processes. By "elastomeric fiber" is meant a continuous filament which, free of diluents, has a break elongation in excess of 100% independent of any crimp, and which, when stretched to twice its length, held for one minute, and then released, retracts to less than 1.5 times its original length within one minute of being released. Such elastomeric fibers are formed from polymers including, but not limited to, rubber, spandex, polyetherester, and elastoester. Elastomeric fibers differ from "elastic fibers" or "stretch fibers," which have been treated in such a manner as to have the capacity to elongate and contract. "Elastic fibers" or "stretch fibers" have modest power in contraction, and include, but are not necessarily limited to, fibers formed by false-twist texturing, crimping, etc.

Elastomeric yarns can be formed with elastomeric fibers produced from fiber-spinning processes, such as dry spinning, wet spinning, or melt spinning. In particular, dry spinning is the process of forcing a polymer solution through spinneret orifices into a chamber to form a filament or filaments. Heated inert gas is passed through the chamber, evaporating the solvent from a filament as the filament passes through the chamber. Multiple filaments are coalesced together while passing through the chamber, thereby forming an elastomeric yarn.

As shown in FIGS. 1 to 7 (Prior Art), continuous-filament elastomeric single filaments or yarns produced by any of these spinning technologies generally are wound onto individual cylindrical tube cores 10 to form supply packages 20 of required size and weight. Package dimensions and weight depend, for example, on the yarn denier, the end-use requirements of the yarn, and the winding equipment employed in the process. The yarn length 12 wound around a core 10 to form a package 20 has a proximal or beginning end 14 and a distal or terminal end 18. The beginning end 14 is located on or adjacent to the outer circumferential surface of the tube core 10, which core 10 supports the inside diameter of the wound yarn package 20. This beginning end 14 is also called a "transfer tail."

The transfer tail 14 preferably is located on the tube core 10 in a position outside the body of the package 20 as illustrated in FIG. 5. To begin winding a yarn package 20, the transfer tail 14 is formed by winding a number of wraps of yarn in a single location along the tube core 10 to form a bunch on the tube core. This bunch holds the transfer tail 14 in place. Then, the yarn 12 is wound or coiled over the tube core 10 in a yarn-traverse motion to form the yarn package 20.

Although the transfer tail 14 is preferably located outside the body of the package 20, as described above, it is more usually trapped under the yarn windings in the yarn package as illustrated in FIG. 3. This is normally the result of equipment or process limitations. When the yarn package has a desired diameter, the yarn is broken by the action of the winding equipment to leave a terminal or distal end 18. The terminal end 18 of the yarn length is located on the outside-diameter surface of the yarn package (FIGS. 3 and 4).

All individually wound packages of elastomeric yarns must be unwound for use in subsequent processes, such as, for example, covering, knitting, and weaving. Currently, packages of elastomeric yarn are unwound by beginning at the outside of the yarn package and pulling the yarn from its terminal or distal end 18. This method of unwinding will be designated herein as "outside in" because the yarn package 20 is unwound continuously from the outside until reaching the outer circumferential surface of the tube core 10 and the distal or beginning end 14 (transfer tail) of the yarn length.

To continuously unwind multiple packages of elastomeric yarn for uninterrupted delivery to subsequent processes, one must be able to fix or tie an end of a yarn length from a first package to an end of a yarn length from a second package, and so on. Generally, the transfer tail of the first package is tied to the terminal or distal end of the second package. One method for continuous unwinding of yarn from multiple yarn packages is called "overend outside-in unwinding" and is shown schematically in FIG. 7. With such unwinding method, the yarn is pulled away from the package in a direction along the axis of the tubular core and is unwound over the end of the package. In the example shown in FIG. 7, the tube cores 10*a*, 10*b* and 10*c* of three yarn packages 20*a*, 20*b* and 20*c*, are loaded onto spools 24*a*, 24*b* and 24*c*. Before the unwinding begins, the transfer tail 14*a* is tied by knot 13*a* to the beginning end 12*b* of the second yarn package 20*b*, and the transfer tail 14*b* of the second yarn package 20*b* is tied by knot 13*b* to the beginning end 12*c* of the third yarn package 20*c*. The yarn 12*a* from first yarn package 20*a* is unwound from the outside in. After all yarn has been unwound from the first yarn package 20*a*, the unwinding process continues by next unwinding yarn from the second yarn package 20*b*, and so on.

Continuous unwinding processes where elastomeric yarns are unwound from the outside-in have encountered problems. If the transfer tail of a package is trapped, it is generally not possible or practical to retrieve the trapped end for tying it together to the beginning end of a next yarn package. The yarn tension necessary to unwind the yarn in an overend outside-in method is related to factors such as the yarn takeoff speed, the denier of the yarn, the dimensions of the package and the tackiness of the yarn surface, to name some important variables. For elastomeric yarns, it is desirable and necessary to keep the pulling tension low and minimize variations in that tension during unwinding, because elastomeric yarns have a low modulus of elasticity and are very sensitive to tension. Variable yarn elongation during unwinding can affect subsequent product quality. Furthermore, when the unwinding yarn is transferred to another package by means of a transfer tail tied to the beginning end of the next package, there is normally a sharp increase in yarn tension for a very short time interval—i.e., a tension spike. This tension spike occurs while unwinding the last few wraps of the yarn on the tube core. The spike affects unwound-yarn quality and can also cause the yarn to break, which is an expensive interruption to the process.

As mentioned above, the unwinding tension is related to the tackiness of the yarn, or the tendency for the yarn to stick to itself and to other materials. All elastomeric yarns, as spun and without special chemical additives or surface finishes, have some degree of surface tackiness. This tackiness is especially evident with wound packages of dry-spun spandex, where the compressive pressure on underlying yarns can be very high due to the stretch and tension of the yarn as it is being spun and wound, which is a natural requirement of the process. The compressive pressure is greatest on the yarn wound near the core of the package. This can make it especially difficult to unwind and use yarn wound near the core of the package, where conditions are most extreme. In addition, time and temperature contribute to tackiness, so that packages of spandex that have been stored, for example for months, are more difficult to unwind and experience significantly more core waste than freshly spun and wound packages.

Reducing the tackiness and the resulting waste would improve the economics of spandex yarn and filament production. For some spandex-yarn applications, however, methods to reduce tackiness are not acceptable because the yarns will be made into garments using adhesives that must adhere effectively to the elastomer yarn surface. Moreover, even if a transfer tail is available, continuous unwinding of multiple packages of high tack yarns generally has not been practical because the severe tension spike during package transfer will often break the yarn. Especially for tacky elastomeric yarns, new methods of unwinding with reduced and more uniform yarn tensions are needed for improved process continuity and product quality.

SUMMARY OF THE INVENTION

Figure 1:
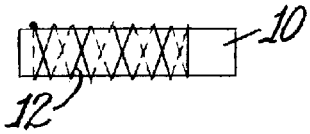
Fig. 1. (Prior Art)
FIG. 1 is a schematic view in front elevation of the beginning windings of elastomeric yarn around a tube core.
Figure 2:
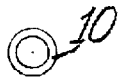
Fig. 2. (Prior Art)
FIG. 2 is a schematic view in side elevation of the beginning windings around a tube core of FIG. 1.
Figure 3:
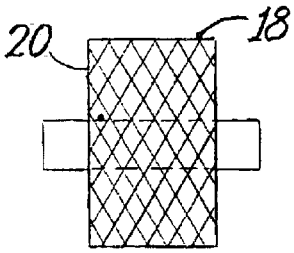
Fig. 3. (Prior Art)
FIG. 3 is a schematic view in front elevation of a wound yarn package where the yarn has been wound over the transfer tail thus trapping the transfer tail and preventing access thereto.
Figure 4:
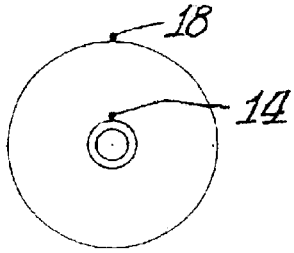
Fig. 4. (Prior Art)
FIG. 4 is a schematic view in side elevation of the yarn package of FIG. 3.
Figure 5:
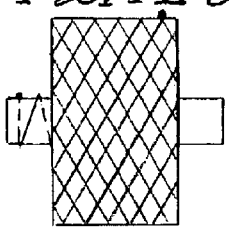
Fig. 5. (Prior Art)
FIG. 5 is a schematic view in front elevation of a wound yarn package where the transfer tail is accessible along the surface of the tube core.
Figure 6:
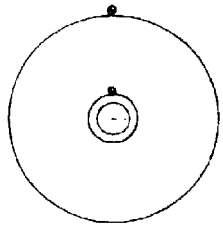
Fig. 6. (Prior Art)
FIG. 6 is a schematic view in side elevation of the yarn package of FIG. 5.

The invention concerns methods for continuous unwinding of elastomeric yarns from one or multiple coiled yarn packages. Distinguishing from prior art unwinding methods that unwound yarn from the outside diameter toward the transfer tail at the inside diameter, the inventive methods unwind the yarn from the inside diameter of the package toward the outside diameter of the package.

According to a first method of the invention, elastomeric yarns from multiple yarn packages of the same or different elastomeric materials are connected together so that the yarns may be unwound in series. Each yarn package has an inner diameter and an outer diameter and the yarn has been wound or coiled around a generally tubular core. The yarn packages preferably are readied for unwinding. Optionally, the outer circumferential peripheral surface of each yarn package may be coated or wrapped with a stabilizing film. A sufficient portion of the tubular core from each coiled yarn package, preferably the entire tubular core, is removed to expose the inner diameter surface of each annular yarn package, or cake. A beginning end of a yarn strand at the exposed inner diameter of each yarn package is located. A loop of a strand of yarn from within a first yarn package at a point between the inner diameter and the outer diameter of the first yarn package is exposed and cut to form a first cut end and a second cut end. The first cut end of the first yarn package is connected to the beginning end of a next yarn package. Where more than two yarn packages will be unwound in series, the step of connecting the first cut end of an adjacent yarn package to the beginning end of a next yarn package is continued until the strands from all of the yarn packages have been connected in series.

Unwinding proceeds by first drawing the beginning end of the first yarn package away from the first package. Preferably, the yarn is unwound from the first yarn package by pulling the yarn generally axially with the unwinding proceeding first by pulling yarn from the inner diameter of the first yarn package. Once the first yarn package has been substantially completely unwound, the connection between the first cut end of the first yarn package and the beginning end of the next yarn package is reached. Unwinding then continues with the unwinding of elastomeric yarn from the next yarn package. The unwinding of the next yarn package is from the beginning end at the inner diameter outward toward the outer diameter of the next yarn package. A shell portion of the first package comprising a length of the yarn from the second cut end to the outer diameter of the yarn package is not unwound. The shell portion preferably constitutes the annular periphery of the yarn package and has an outer diameter that is from about 2 to about 5 mm larger than its inner diameter.

Unlike with the prior art, during the transfer of unwinding between the first and next yarn packages, the unwinding proceeds at a more constant tension without a pronounced tension spike as had frequently occurred with prior unwinding methods. It is desirable to keep the unwinding tension as low as possible. Preferably, for elastomeric yarns the unwinding tension is kept below about 20 grams, most preferably below about 10 grams.

Preferably, the entire tubular core is removed from the yarn package by (i) chilling the yarn package to a temperature at least a few degrees below the melting point or glass transition temperature of the soft segment of the polymer, which is sufficient to cause the polymer to expand and create a gap between the outer circumference of the tubular core and the windings; and (ii) separating the core from the yarn package. The tubular core can be removed axially. In view of the material property changes upon chilling the elastomeric material, it is preferred that the yarn package be returned to ambient temperature before locating the beginning end or transfer tail, forming the loop to create the terminal end or unwinding yarn from the yarn package.

Preferably, the yarn packages contain an elastomeric yarn formed from filaments of a polymeric material selected from the group consisting of: rubber, spandex, polyetherester and elastoester. Most preferably, the yarn packages are of yarns formed from filaments of tacky dry spun spandex with a nominal denier in the range of 120 to 3600 that have not been coated with a surface finish or formed from a polymer that incorporates anti-tack additives.

According to a second aspect of the invention, the inside-out unwinding method minimizes tension spikes when unwinding an elastomeric yarn having a tacky surface. The method may be used in connection with unwinding a single yarn package or unwinding multiple yarn packages that have had the yarn strands therefrom connected in series. According to this method, at least a portion of the tubular core from the coiled yarn package is removed to expose an inner diameter of the yarn package. A beginning end of a yarn strand at the inner diameter portion of the yarn package is located. Before unwinding, the elastomeric yarn strand is cut at a position along its length to form a terminal end of the strand within the yarn package between the inner diameter and the outer diameter. Preferably, the terminal end is formed by cutting the yarn strand in the yarn package at a location within about 2 to about 5 mm from the outer diameter of the yarn package.

To unwind the elastomeric yarn, the beginning end of the yarn package is drawn away from the yarn package so that unwinding proceeds from the inner diameter toward the outer diameter. Preferably, at any point during the unwinding the instantaneous unwinding threadline tension remains within a range that is not more than double and not less than one-half of the average unwinding threadline tension of the elastomeric yarn as such yarn is unwound at or near the midpoint of the yarn package. Preferably, the average unwinding threadline tension is measured over 30 seconds at about 100 meters per minute withdrawal speed. The unwinding threadline tension does not exhibit pronounced spikes during unwinding a single package or during transfer from a first to a next yarn package.

The methods of the invention have particular application for unwinding yarn packages of spandex having a denier greater than about 120, where the yarn package has a package weight of between about 1 to 5 kilograms, with an inside diameter of between about 7 to about 9 cm, an outside diameter of between about 10 to about 40 cm, and a width of between about 8 to about 25 cm.

DESCRIPTION OF THE PREFERRED EMBODIMENTS

During manufacturing, continuous-filament elastomeric yarn 12 is wound onto a cylindrical tube core 10 while the yarn 12 is under a condition of some stretch and tension to produce a yarn package 20. The yarn 12 is wound very tightly onto the tube core 10, and under ambient conditions it is not possible to remove the tube core without damaging or destroying the yarn in the yarn package. As noted previously, conventional unwinding proceeded "outside in", where the yarn strand was unwound from the outside diameter of the yarn package first.

To unwind elastomeric yarn from a package from the "inside out", one needs to have access to the beginning end of the yarn strand that has been wrapped over the core. To obtain such access, the tube core must be removed from the package without damaging the yarn.

One preferred method for removing the tubular core is to chill the yarn package (with its core therein). Once chilled, a gap forms between the tubular core and the elastomeric yarn around such core. It is then possible to remove the tubular core from the chilled package.

Figure 8:
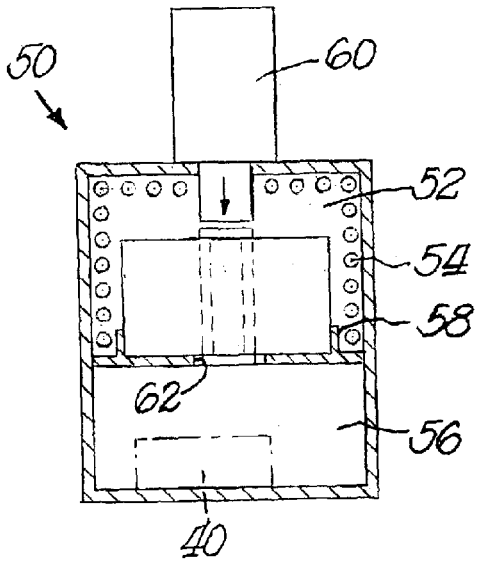
FIG. 8 is a schematic cross-sectional view in front elevation of a yarn package within a cooling chamber and showing removal of the tube core as a first step in a method for unwinding the yarn from the inside out.

One possible method for removing the tube core 40 is illustrated in FIG. 8. A yarn package 30 having a continuous yarn strand 32 wrapped about the core 40 is placed into a cooling chamber 52 of cooling equipment 50. The yarn package 30 is held within an annular sleeve 58 formed in the floor of chamber 52. The cooling chamber 52 is surrounded at its periphery with cooling coils 54 sufficient to cool the chamber 52 to a desired chilling temperature. An exit chamber 56 is located below the floor of chamber 52.

Once the yarn package 30 has reached the desired chilling temperature, the yarn 32 separates from the core 40 and a small gap forms between the yarn 32 and the core 40. As shown in FIG. 8, a ram 60 is actuated to push the core 40 axially out of the yarn package 30 and into the exit chamber 56 through a passage 62 between the cooling chamber 52 and the exit chamber 56. For many yarn packages, the gap between the yarn 32 and the core 40 may be large enough to allow the core to drop out of the yarn package simply in response to gravitational force, without applying a ramming force. The core 40 is then discarded. The yarn package 30 now separated from the core 40 is removed from the cooling chamber 52 and installed in a fixture or holder to prepare for unwinding. Preferably, the chilling temperature should be at least a few degrees below that at which the elastic modulus of the elastic yarn changes rapidly. This temperature depends on the composition of the elastomeric fiber, but the effect is the same once the proper temperature is attained. For example, the chilling temperature for most spandex yarns should be at or below about—[minus] 8° C. For spandex yarn based on 1800 molecular weight poly (tetramethylene glycol) or poly (tetrahydrofuran), the soft segment melting point is about—[minus] 8° C., and the core is easily removed after the yarn package has been cooled to about—[minus] 25° C. For other elastomeric yarns, the glass transition temperature of the soft segment is below—[minus] 8° C. (e.g., spandex based on a tetrahydrofuran/3-methyl-tetrahydrofuran copolymer) and the chilling temperature may need to be lower.

After the tube core 40 has been removed, the package 30 is a yarn "cake" that defines an inner diameter and an outer diameter. The "cake" has a hollow cylindrical interior where the starting end 34, or transfer tail, of the yarn 32 is located. The other end of the continuous yarn in the package 30 is on the outer circumferential surface of the package at the outside diameter.

The transfer tail 34 is now fully accessible, whether or not it was previously trapped under the body of yarn wrapped over the core to form the package. Once the transfer tail is located by visual inspection, it can then be pulled out a distance of several meters to remove the transfer-tail "bunch" and to confirm that the yarn is free to be pulled and unwound without snagging or tangling. The single yarn cake can be positioned within a fixture or holder and yarn can be unwound from the cake from the inside out. Preferably, the beginning end or transfer tail 34 is retrieved and the unwinding begins after the yarn package 30 has returned to ambient conditions, or room temperature.

For commercial operations which use the elastomeric yarn by unwinding, it is economically advantageous to tie packages of yarn together so that unwinding can proceed from one package to another in series, without interruption, and thereby maintain process operation continuity. In conventional "outside in" unwinding methods, this is accomplished by tying the transfer tail of one package to the outside-diameter end of another package.

Figure 12:
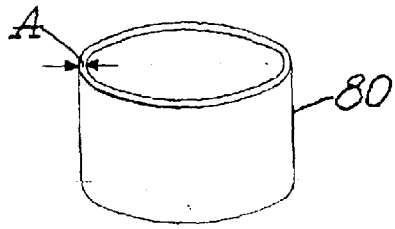
FIG. 12 is a schematic perspective view of the waste portion of the yarn package after unwinding according to the method of the invention.

Unwinding of yarn from the "inside out", however, proceeds from the inside of the cake thereby further hollowing out the standalone cake until smaller and smaller amounts of yarn remain in the "shell" of the package. As shown in FIG. 12, the shell 80 has a thickness "A" and an outer diameter substantially the same as the yarn package 30. At some point the shell 80 no longer will self-stand, but will partially collapse, or slump, thereby causing yarn not yet unwound to entangle, thus foreclosing unwinding 100% of the yarn and uninterrupted transfer between packages.

According to one aspect of the invention herein, however, uninterrupted and continuous unwinding of multiple packages from "inside out" is accomplished. The method is illustrated schematically in FIGS. 9 to 11.

Figure 9:
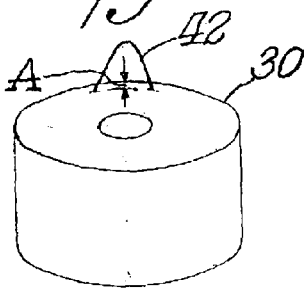
FIG. 9 is a schematic perspective view of a yarn package in which a loop of yarn is pulled axially from the package within a certain distance from the outer diameter of the package as a second step in a method for unwinding the yarn from the inside out.

First, as shown in FIG. 9, a loop 42 of yarn is pulled from the side of the wound yarn package 30, at distance, "A", that is appropriate to assure standalone shell stability of the particular package. While the distance "A" may be at any spacing between the inner diameter and outer diameter of the yarn package 30, a smaller distance "A" translates into a smaller shell thickness and reduces the amount of wasted yarn from the yarn package. A particularly preferred shell thickness "A" is 5 mm or less, most preferably from about 2 mm to about 5 mm. The minimum required standalone-shell thickness "A" depends on a number of factors, including, but not limited to, the elastomeric yarn denier, package dimensions and weight, and yarn tackiness.

Figure 10:
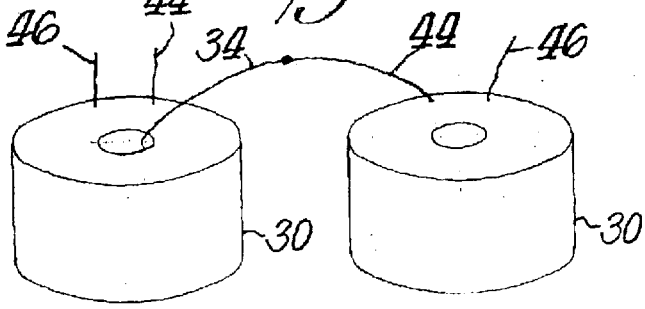
FIG. 10 is a schematic perspective view of two yarn packages in which the newly created terminal end of the yarn length of the first yarn package has been tied to the newly created beginning end of the second yarn package as a third step in a method for unwinding the yarn from the inside out.

Referring next to FIG. 10, the loop 42 is then cut, resulting in two ends 44 and 46. The first cut end 44 is then attached, such as by tying, to the transfer tail or beginning end 34 of another package. The chosen end 44 must be the one that is connected to the body of the package, and not the end 46 connected to the shell of the package. One can determine the correct end from the first package to attach to the transfer tail of the next package by observing the direction of rotation, clockwise or counterclockwise, of the first package's transfer tail as it is pulled from the inner diameter of the package. From this, one can thereby ascertain which of the cut ends 44, 46 would first be intercepted by this transfer tail if the yarn strand were fully unwound to that point. The end 44 that would be first intercepted is the end to be tied. After tying, the packages can be unwound sequentially from the inside out as illustrated in FIG. 10.

Figure 11:
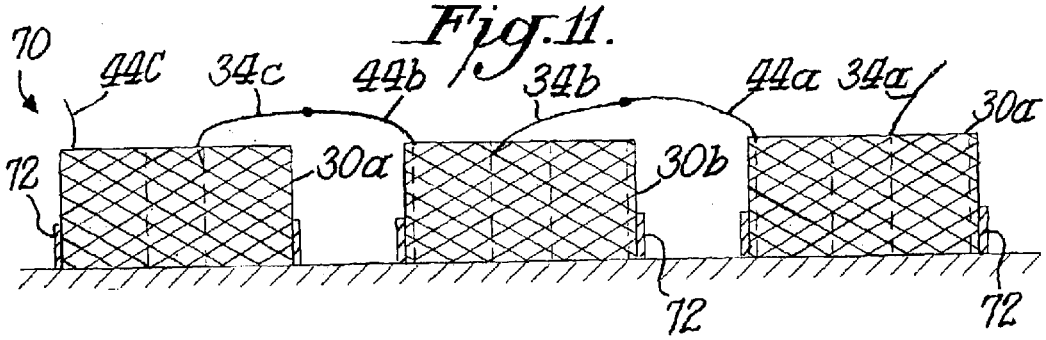
FIG. 11 is a schematic view in front elevation of three yarn packages seated within sleeves and having yarn ends tied together for continuous inside out unwinding.

Referring next to FIG. 11, a series of three yarn packages 30*a*, 30*b*, and 30*c* forms a yarn unwinding or delivery system 70. Each of the yarn packages has been installed in its own upstanding annular sleeve 72 that supports the yarn package during unwinding. Before unwinding begins, the first cut end 44*a* of the first yarn package is tied to the beginning end 34*b* of the second yarn package 30*b*. In addition, the first cut end 44*b* of the second yarn package 30*b* is tied to the beginning end 34*c* of the third yarn package 30*c*.

When unwinding begins, the beginning end 34*a* of the first yarn package 30*a* is the first to be pulled generally axially away from the yarn package to unwind the yarn from the inside out. Once the first yarn package 30*a* has been substantially completely unwound, unwinding continues without interruption to the second yarn package 30*b* via the cut end 44*a* tied to the beginning end 34*b* of the second yarn package 30*b*. The second yarn package 30*b* is unwound from the inside out until the second yarn package has been substantially completely unwound. Unwinding then continues without interruption to the third yarn package 30*c* via the cut end 44*b* tied to the beginning end 34*c* of the third yarn package 30*c*.

Upon completing unwinding of all three yarn packages, the shell 80 of yarn from the second cut end to the outer diameter of each yarn package, as shown in FIG. 12, comprises waste and is not unwound. Such shells 80 are removed and discarded. While FIG. 11 shows three yarn packages, the invention is not limited to any specific number of yarn packages. Multiple yarn packages may be attached in series and continuously unwound according to the method of the present invention. Indeed, even with a limited number of sleeves 72, such as shown in FIG. 11, unwinding of multiple packages could be continued after removing the spent shells 80 and installing in their place additional yarn packages that may have their respective beginning ends connected to the respective cut ends of preceding yarn packages.

Preferably, the yarn packages contain an elastomeric yarn formed from filaments of a polymeric material selected from the group consisting of: rubber, spandex, polyetherester and elastoester. Most preferably, the yarn packages are of yarns formed from filaments of tacky dry spun spandex with a nominal denier in the range of 120 to 3600 that have not been coated with a surface finish or formed from a polymer that incorporates anti-tack additives.

As yarn is unwound from the inside, the remaining shell 80 becomes thinner and thinner until it reaches a point where it no longer has the structural integrity to stand and thus collapses. Inside-out unwinding then should be stopped or transferred to another package before collapse, and before yarn entanglement, occurs. Although it would be advantageous to unwind 100% of the yarn strand 32 forming the yarn package 30, this is not required for purposes of the present invention.

The cylindrical shell 80 of elastomeric yarn can be stabilized to delay collapse or slumping by coating the outside surface of the yarn package 30 with an adhesive coating, or by wrapping and gluing an appropriate sleeve or film to the outside surface of the package 30 before unwinding. Preferred sleeves or films comprise adhesive-backed paper such as used for shipping labels, package sealing tape, fiberglass-reinforced strapping tape and masking tape.

Once the outer surface of the yarn package is coated, more of the yarn may be unwound (e.g. the distance "A" of the shell left after winding may be smaller) than with an uncoated yarn package. The package sleeve material can provide independent columnar strength to the cake shell by adhesively connecting outer layers of the elastomeric fibers to the sleeve. Ideally, an adhesive that does not penetrate many multiple winding layers of wound fiber is best. With the proper adhesive or sleeve or film, the near-outside end can located at a distance "A" that is less than 5 mm, and preferably less than 2 mm, and more of the yarn may be unwound from the package, thus minimizing waste.

A particularly difficult elastomeric yarn to unwind is a dry-spun spandex yarn of greater than 120 denier without applied surface finish, which yarn was formed without addition of any anti-tack substances to the polymer solution. This yarn exhibits high-tackiness, or high-tack. Such dry-spun spandex generally is formed into a yarn package that has a net cake weight of between about 1 and 5 kilograms, with an outside cake diameter typically between about 17 to 40 centimeters, an internal cake diameter from about 7.5 to 8.5 centimeters; and a cake width, L, from about 8.5 to 25 centimeters. The yarn can either be freshly spun, or stored for a period of time. Surprisingly, under these conditions the integrity of the package shell is sufficient so that the wall thickness, "A", can be chosen to be 5 millimeters or less and still avoid shell collapse and yarn entanglement.

EXAMPLES

#1 Single-Package Unwinding

Tensions were measured at multiple points throughout the unwinding of a nominal 700-denier Lycra® spandex yarn with no surface finish and no anti-tack additives. The Lycra® spandex packages had an initial net weight of three kilograms, and were aged two months from manufacture. Yarn tension and tension variability were compared between inside-out unwinding and control outside-in unwinding. The yarn takeoff speed was 100 meters/minute. The results are shown in Table I below and graphically in FIG. 13.

Figure 13:
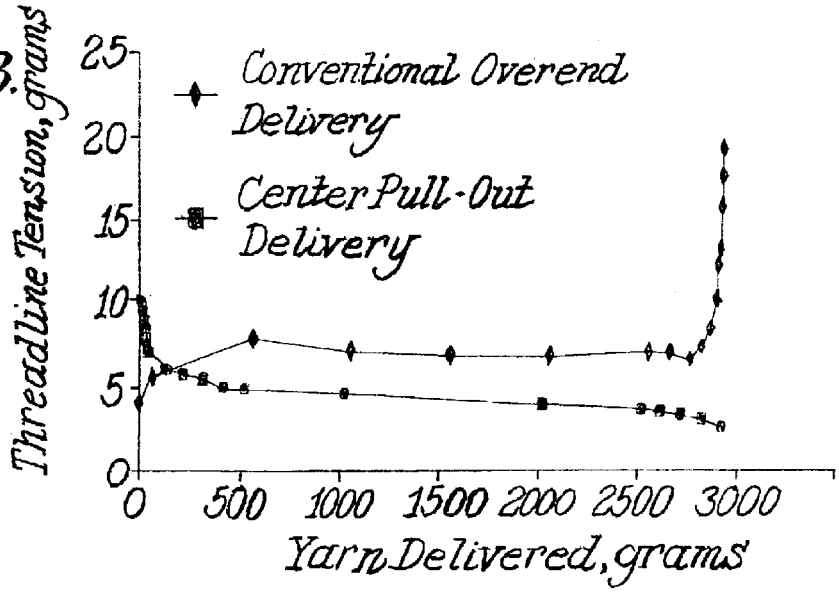
FIG. 13 is a graph depicting the yarn tension versus yarn delivered for overend outside in unwinding according to the prior art and inside out unwinding according to the invention.
Figure 14:
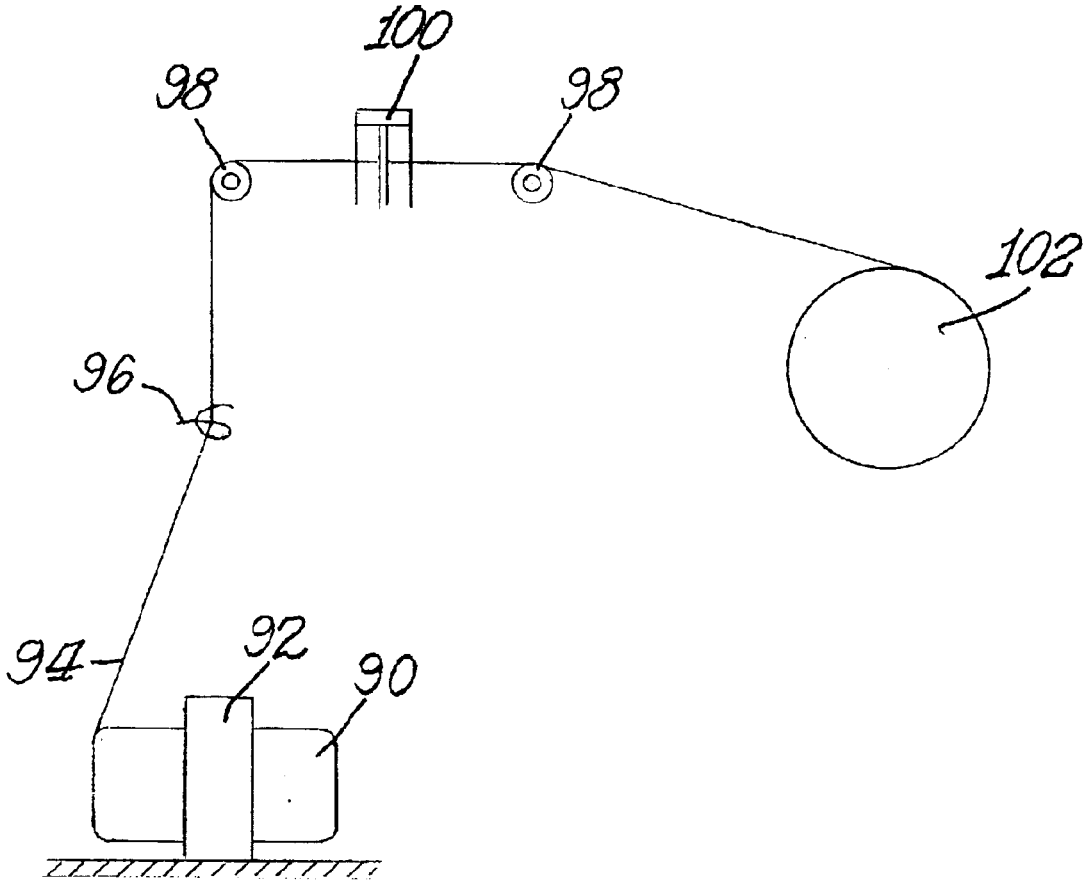
FIG. 14 is a schematic view of an apparatus for measuring unwinding threadline tension.

For this Example #1, the unwinding equipment and associated tensiometer are shown schematically in FIG. 14. The yarn package 90 comprised a winding of the spandex yarn held within a sleeve. A threadline 94 taken from the inside core of the package 90 was passed through a pigtail guide 96 and over a series of roller guides 98 to a take-up roll 102. The threadline was passed through a tensiometer 100 before it was wound up on the take-up roll 102. A Rothschild Tensiometer from Rothschild Instrument of Zurich, Switzerland was used. The tensiometer 100 had a range of tension measurement from 0 to 40 g, and typically samples and stores five (5) tension readings per second. The tensiometer interfaces with a computer that plots or charts tension data over time. The tensiometer can be operated in various modes to provide graphical representations of tension data. Two common modes are (1) a 30 second run with a report of the average tension over that time; and (2) an extended (30 to 90 minute) run with a running plot of the sampled (five per second) tension measurements. Each data point in FIG. 13 is a mode (1) result.

TABLE I

| Conventional Overend Yarn delivered | Delivery tension | Center Pull-out Yarn delivered | Delivery tension |
|---|---|---|---|
| 0 | 4.36 | 0 | 10.02 |
| 60 | 5.74 | 3.13 | 9.42 |
| 560 | 7.88 | 6.25 | 9.17 |
| 1060 | 7.04 | 9.38 | 8.46 |
| 1560 | 6.80 | 12.5 | 8.50 |
| 2060 | 6.70 | 15.63 | 8.18 |
| 2560 | 7.00 | 18.75 | 8.29 |
| 2660 | 6.97 | 21.90 | 7.79 |
| 2760 | 6.68 | 25 | 7.40 |
| 2820 | 7.33 | 120 | 6.16 |
| 2860 | 8.50 | 220 | 5.87 |
| 2870 | 8.28 | 320 | 5.64 |
| 2880 | 8.45 | 420 | 5.06 |

TABLE I-continued

| Conventional Overend Yarn delivered | Delivery tension | Center Pull-out Yarn delivered | Delivery tension |
|---|---|---|---|
| 2900 | 10.11 | 520 | 4.96 |
| 2910 | 12.20 | 1020 | 4.78 |
| 2920 | 13.28 | 2020 | 4.03 |
| 2930 | 15.68 | 2520 | 3.78 |
| 2940 | 19.21 | 2620 | 3.61 |
| 2943 | 17.38 | 2720 | 3.43 |
| 2945 | 16.03 | 2920 | 2.64 |

As shown in the data in Table I and graphically in FIG. 13, the yarn tension for the inside-out unwinding according to the invention remained at about 10.0 grams or below throughout the unwinding of the yarn package. In contrast, the yarn tension spiked to well over 10.0 grams at the end of the unwinding for the example according to conventional outside-in unwinding. The Example unwound according to the invention experienced more consistent drawing tension and did not experience a pronounced yarn tension spike at the end of the unwinding.

#2 Multiple-Package Unwinding

Yarn packages were tied together per the method of the invention, whereby the internal end of a second cake was tied to a near-outside end (about 5 millimeters from outside) of a first cake and so on, such as illustrated in FIG. 11. The yarn was a nominal 700-denier Lycra® spandex yarn with no finish and no anti-tack additive. The yarn cakes had an initial net weight of three kilograms, and were aged two months from manufacture. The yarn takeoff speed was 100 meters/minute. Yarn tension was measured just before and after the transfer of unwinding between cakes, in order to measure the tension "spike" at transfer.

Figure 7:
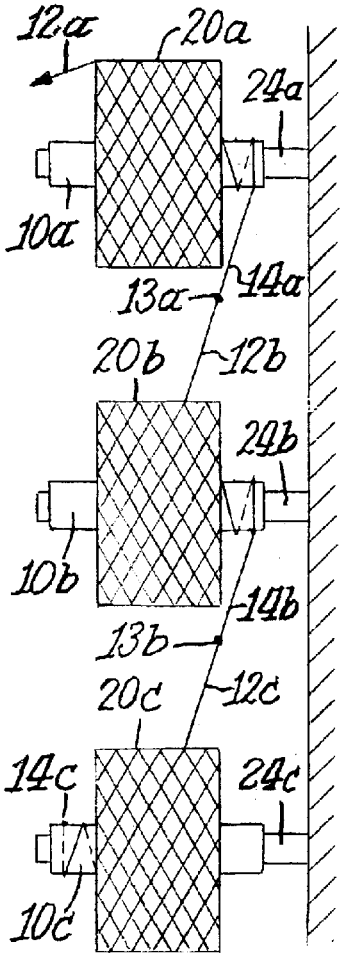
Fig. 7. (Prior Art)
FIG. 7 is a schematic view in front elevation of a series of three yarn packages mounted to spools and having yarn ends attached together for continuous overend outside-in unwinding.

A second set of packages was tied together in a conventional way, whereby the internal yarn end of one package was tied to the outside-surface end of an adjacent package. Unwinding was the standard outside in, per FIG. 7, and tension spikes at transfer were measured for comparison.

Figure 15:
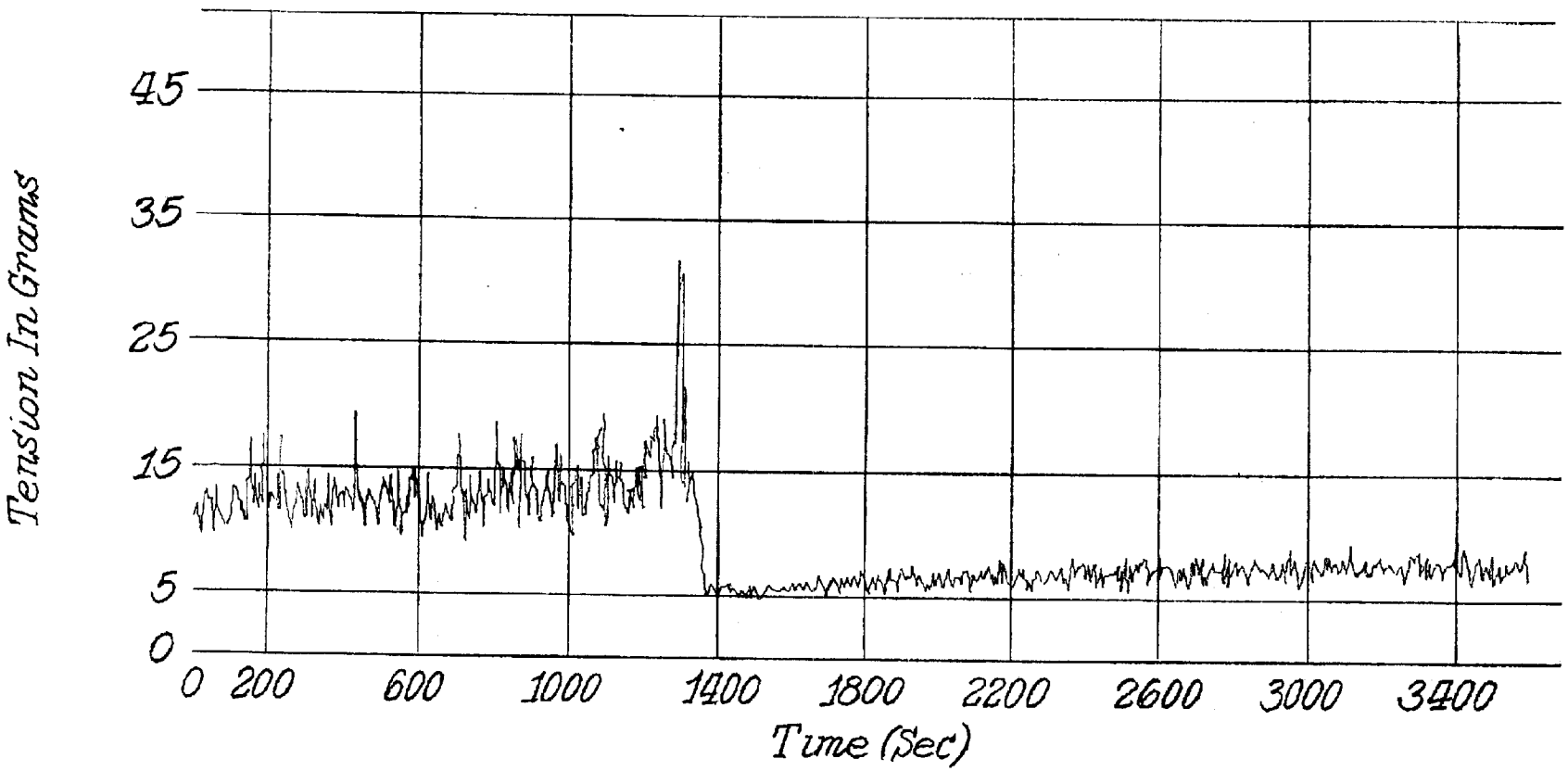
FIG. 15 is a graph depicting the threadline tension versus time for overend outside in unwinding according to the prior art, showing a pronounced tension spike at transition to next package.
Figure 16:
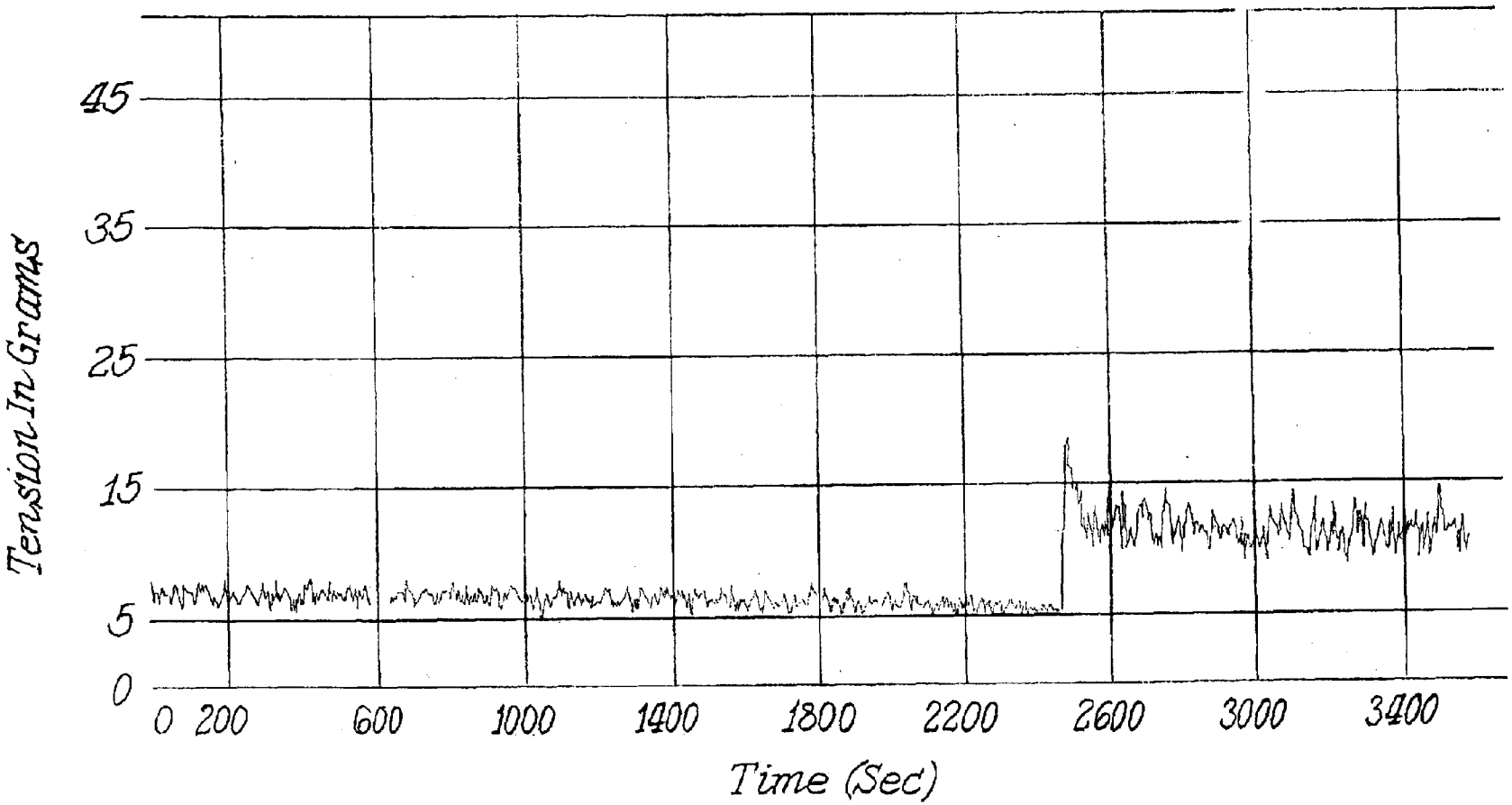
FIG. 16 is a graph depicting the threadline tension versus time for inside out unwinding according to the invention, showing a reduced tension spike at transition to next package (compared with tension spike experienced with prior art unwinding as shown in FIG. 15).

FIGS. 15 and 16 graphically represent the tension data obtained during unwinding of the yarn packages of Example #2. The Rothschild Tensiometer was in extended run mode (mode (2) with a running plot of sampled tension measurements at five measurements per second). The standard resolution available on the tensiometer was used.

As shown in FIG. 15, the outside-in unwinding tension averaged about 13 to 15 grams prior to the transfer to the next yarn package, at which point the unwinding tension was from yarn near the inner diameter of the yarn package. At about 1300 seconds of unwinding time when the unwinding transferred from the first package to the next for outside-in unwinding according to the prior art, the unwinding tension spiked to over 30 grams, which was more than double the average unwinding tension experienced prior to the transfer. A spike of this magnitude can be severe enough to break the threadline for many elastomeric yarns. Following the transfer spike, the unwinding tension dropped to an average between about 5 and 8 grams when unwinding the next yarn package from near the starting outside diameter.

In contrast, as shown in FIG. 16, the inside-out unwinding tension averaged between about 5 to 7 grams before the transfer when unwinding from near the outside diameter of the yarn package. At about 2500 seconds, the unwinding tension rose to about 18 grams, which remained below about 20 grams for inside out unwinding according to the invention. The unwinding tension did not have a pronounced spike as with the prior art, but elevated to the somewhat higher tension level experienced between unwinding from an outer portion of the package (lower tack) to the inside core of the next package (higher tack). The unwinding tension at the inner diameter of the next yarn package averaged about 12 to 13 grams as unwinding continued.

I claim:

1. A method for unwinding a continuous length strand of elastomeric yarn from two or more coiled yarn packages, wherein each said yarn package has an inner diameter and an outer diameter, comprising:

(a) removing at least a portion of a tubular core from each coiled yarn package to expose the inner diameter of each yarn package;

(b) locating a beginning end of a yarn strand at the inner diameter of each yarn package;

(c) exposing a loop of a strand of yarn from within a first yarn package at a point between the inner diameter and the outer diameter;

(d) cutting the loop to form a first cut end and a second cut end;

(e) connecting the first cut end of the first yarn package to the beginning end of a next yarn package; and (f) unwinding the elastomeric yarn by first pulling the beginning end of the first yarn package away from the first package and continuing to unwind elastomeric yarn from the next yarn package.

2. The method of claim 1, wherein the elastomeric yarn is formed from filaments of a polymeric material selected from the group consisting of: rubber, spandex, polyetherester and elastoester.

3. The method of claim 1, wherein the elastomeric yarn is formed from filaments of tacky dry spun spandex with a nominal denier in the range of about 120 to about 3600.

4. The method of claim 1, wherein prior to removing the tubular core each yarn package has windings of elastomeric yarn around the outer circumference of the tubular core, and the entire tubular core is removed by (i) chilling the yarn package to a temperature sufficient to cause a gap to form between the outer circumference of the tubular core and the windings; and (ii) separating the core from the yarn package.

5. The method of claim 4, further comprising unwinding the yarn from the first yarn package after the first yarn package has returned to ambient temperature.

6. The method of claim 1, wherein each yarn package defines its own center axis, and as the yarn length is unwound from each yarn package, the unwinding is by pulling the yarn generally axially with the unwinding proceeding first by pulling yarn from the inner diameter.

7. The method of claim 1, wherein a shell portion of a first cake comprising a length of the yarn from the second cut end to the outer diameter of the yarn package is not unwound.

8. The method of claim 7, wherein the shell portion has an inner diameter and an outer diameter and the outer diameter is up to about 5 mm greater than the inner diameter.

9. The method of claim 1, wherein each yarn package has an outer circumference at its outer diameter and said circumference is wrapped or coated to increase the columnar strength of the yarn package.

10. The method of claim 1, wherein unwinding threadline tension is maintained at or below about 20 grams while elastomeric yarn is unwound from each yarn package.

11. The method of claim 1, wherein the elastomeric yarn is not treated with a surface finish nor formed from polymeric material having anti-tack additives incorporated therein.

12. A method for minimizing threadline tension spikes when unwinding an elastomeric yarn that has been wound about a tubular core to form a coiled yarn package having an inner diameter and an outer diameter, comprising:

(a) removing at least a portion of the tubular core from the coiled yarn package to expose the inner diameter of the yarn package;

(b) locating a beginning end of a yarn strand at the exposed portion of the inner diameter of the yarn package;

(c) before unwinding, cutting the elastomeric yarn strand to form a terminal end of the strand within the yarn package between the inner diameter and the outer diameter; and (d) unwinding the elastomeric yarn by first drawing the beginning end of the yarn package away from the yarn package so that unwinding proceeds from the inner diameter toward the outer diameter.

13. The method of claim 12, wherein the elastomeric yarn is formed from filaments of a polymeric material selected from the group consisting of: rubber, spandex, polyetherester and elastoester, and said elastomeric yarn has a denier in the range of about 120 to about 3600.

14. The method of claim 13, wherein the elastomeric yarn is not treated with a surface finish nor formed from polymeric material having anti-tack additives incorporated therein.

15. The method of claim 13, wherein the elastomeric yarn is spandex having a denier greater than about 120 and the yarn package has a package weight of between about 1 to 5 kilograms, with an inside diameter of between about 7 to about 9 cm, an outside diameter of between about 10 to about 40 cm, and a width of between about 8 to about 25 cm.

16. The method of claim 12, wherein the terminal end is formed by cutting the yarn strand in the yarn package at a location within about 2 to about 5 mm from the outer diameter of the yarn package.

17. The method of claim 12, wherein the terminal end is connected to a beginning end of a next yarn package.

* * * * *